US007082866B2

(12) United States Patent
Becker

(10) Patent No.: US 7,082,866 B2
(45) Date of Patent: Aug. 1, 2006

(54) RATCHETING TORQUE-ANGLE WRENCH AND METHOD

(75) Inventor: Thomas P. Becker, Kenosha, WI (US)

(73) Assignee: Snap-on Incorporated, Kenosha, WI (US)

( * ) Notice: Subject to any disclaimer, the term of this patent is extended or adjusted under 35 U.S.C. 154(b) by 2 days.

(21) Appl. No.: 10/683,343

(22) Filed: Oct. 10, 2003

(65) Prior Publication Data

US 2005/0061119 A1 Mar. 24, 2005

Related U.S. Application Data

(60) Provisional application No. 60/418,880, filed on Oct. 16, 2002.

(51) Int. Cl.
*B25B 23/147* (2006.01)
*B25B 23/142* (2006.01)

(52) U.S. Cl. ..... 81/479; 81/469; 73/862.23; 702/151

(58) Field of Classification Search ..... 81/467, 81/469, 478, 479, 480; 73/862.21, 862.23; 702/151

See application file for complete search history.

(56) References Cited

U.S. PATENT DOCUMENTS

| | | | | |
|---|---|---|---|---|
| 3,577,815 | A | 5/1971 | Bergquist | |
| 4,016,938 | A | 4/1977 | Rice | |
| 4,026,369 | A | 5/1977 | Vliet | |
| 4,104,778 | A | 8/1978 | Vliet | |
| 4,106,176 | A | 8/1978 | Rice et al. | |
| 4,211,120 | A | 7/1980 | Tambini | |
| 4,558,601 | A | 12/1985 | Stasiek et al. | |
| 4,561,332 | A | 12/1985 | Wood | |
| 4,571,696 | A * | 2/1986 | Bitzer | 81/467 |
| 4,589,289 | A | 5/1986 | Neuhaus | |
| 5,172,616 | A | 12/1992 | Negishi | |
| 5,303,601 | A | 4/1994 | Schönberger et al. | |
| 5,435,190 | A | 7/1995 | Jansson et al. | |
| 5,457,866 | A | 10/1995 | Noda | |
| 5,476,014 | A | 12/1995 | Lampe et al. | |
| 5,526,460 | A | 6/1996 | DeFrancesco et al. | |
| 5,581,042 | A | 12/1996 | Tambini | |
| 5,589,644 | A | 12/1996 | Becker et al. | |
| 5,890,406 | A | 4/1999 | Thorn | |
| 5,963,707 | A | 10/1999 | Carr | |
| 6,070,506 | A | 6/2000 | Becker | |
| 6,144,891 | A | 11/2000 | Murakami et al. | |
| 6,167,788 | B1 | 1/2001 | Schönberger et al. | |
| 6,234,051 | B1 | 5/2001 | Bareggi | |
| 6,276,243 | B1 | 8/2001 | Jenkins | |
| 6,629,055 | B1 * | 9/2003 | McGee et al. | 73/862.21 |
| 2003/0065474 | A1 | 4/2003 | McGee et al. | |

FOREIGN PATENT DOCUMENTS

| | | |
|---|---|---|
| DE | 3128557 | 3/1983 |
| DE | 4235954 | 5/1993 |
| DE | 29724239 | 8/2000 |
| WO | WO 03/013797 A1 | 2/2003 |

* cited by examiner

*Primary Examiner*—Debra S Meislin
(74) *Attorney, Agent, or Firm*—Seyfart Shaw LLP

(57) ABSTRACT

A torque-angle wrench has a torque preset alert circuit which provides a first signal when a predetermined torque level is reached, an angle sensing circuitry providing a second signal corresponding to angular rotation, output circuitry responsive to the second signal for providing an indication of angular rotation, and switch circuitry for preventing the second signal from reaching the output circuitry until the occurrence of the first signal.

10 Claims, 2 Drawing Sheets

RATCHETING TORQUE-ANGLE WRENCH AND METHOD

RELATED APPLICATION

This application claims the benefit of the filing date of copending U.S. Provisional Application No. 60/418,880, filed Oct. 16, 2002 and entitled "Ratcheting Torque-Angle Wrench."

BACKGROUND

This application relates generally to the field of torque angle wrenches and, more particularly, to a torque-angle wrench including a ratchet drive.

A torque wrench measures the torque applied to a fastener as an indication of the joining force or load. However, torque is considerably influenced by friction forces, the condition of the fasteners, the amount, if any, of lubrication present, as well as by other factors. Accordingly, the reliability of a torque measurement as an indication of desired load is significantly variable. For this reason, a torque-angle fastener installation process, rather than torque measurement alone, is recommended in situations where tightening to recommended specifications is critical.

In a torque-angle fastener installation, a fastener is first tightened to a desired torque using a torque wrench, and is then rotated through a predetermined additional angle of rotation. There are various wrenching tools available which meter angular rotation. Such a wrench, which utilizes a piezoelectric gyroscopic element to measure rotation of the fastener during a torquing operation, is disclosed in U.S. Pat. No. 5,589,644 which discloses a wrench with a fixed drive head, and the disclosure of which is incorporated herein by reference. In the use of that wrench, angle measurement is initiated at a predetermined torque level, the torque-measuring and angle measuring phases of the operation all occurring during a single continuous stroke of the wrench.

However, in many applications, such as where there is limited space for rotational movement of the wrench, the use of a ratchet drive on an angle-measuring wrench is desired. With such a ratchet drive, as is well known, the wrench is oscillated back and forth between torque-applying and ratcheting directions. The use of such a ratchet drive introduces error in the angle measurement because of lost motion between ratchet mechanism teeth. For example, a ratchet mechanism may feature a ratchet gear with 36 teeth. Thus, when rotating the wrench in the ratcheting direction, the angular distance between teeth is 10 degrees. Accordingly, the amount of angular rotation "lost motion" of the wrench in the torquing direction could be anywhere between zero and ten degrees before torque is actually applied to the fastener.

Similarly, any looseness between the wrench and the fastener, such as through the use of a socket tool, would introduce additional lost motion. Also, the use of common tools, such as extensions and/or universal drives, would add to the stack-up of lost motion before actually applying torque to the fastener.

Accordingly, in order to accurately, use a ratchet drive with an angle-measuring wrench, it is necessary to account for or ignore the lost motion that may be introduced each time the wrench is rotated in the ratcheting direction.

SUMMARY

This application describes a ratcheting angle-measuring wrench which avoids the disadvantages of prior wrenches while affording additional operating and structural advantages.

An aspect is the provision of an angle-measuring wrench which ignores non-torque-applying movements of the wrench.

Another aspect is the provision of angle-measuring wrench which automatically commences angle measurement at a predetermined torque level.

Yet another aspect is the provision of a torque and angle measuring wrench, wherein the angle-measuring function is disabled until achievement of a predetermined torque.

There is provided a torque-angle wrench comprising: a lever arm, a workpiece-engaging head on the lever arm, a torque preset alert circuit carried by the lever arm and providing a first signal when a predetermined torque level is reached, angle sensing circuitry carried by the lever arm and providing a second signal corresponding to angular rotation of the lever arm, output circuitry responsive to the second signal for providing an indication of angular rotation, and switch circuitry coupled to the torque preset alert circuit and to the angle sensing circuitry and to the output circuitry for preventing the second signal from reaching the output circuitry until the occurrence of the first signal.

There is also provided a method of operating a torque-angle wrench which can perform an angle-measuring function, the method comprising: measuring torque applied by the wrench, detecting when measured torque reaches a predetermined torque level, and preventing operation of the angle-measuring function until the predetermined torque level is reached.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
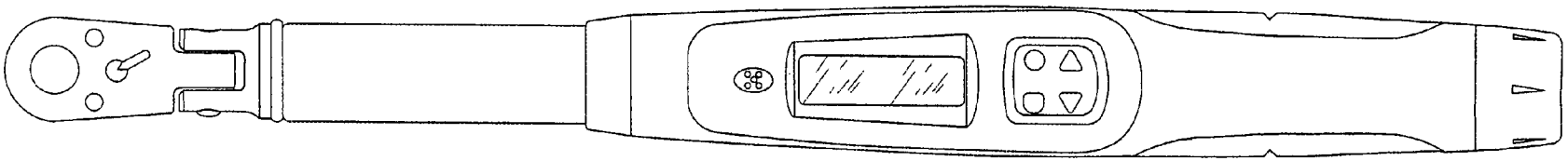
FIG. 1 is a perspective view of a ratcheting torque-angle wrench.

Referring to FIG. 1, there is illustrated a digital torque angle wrench 10 having an elongated shaft 11 provided with a handle portion 12 at one end thereof and provided at the other end thereof with a workpiece-engaging reversible ratchet head 15 connected to the adjacent end of the shaft 11.

Figure 2:
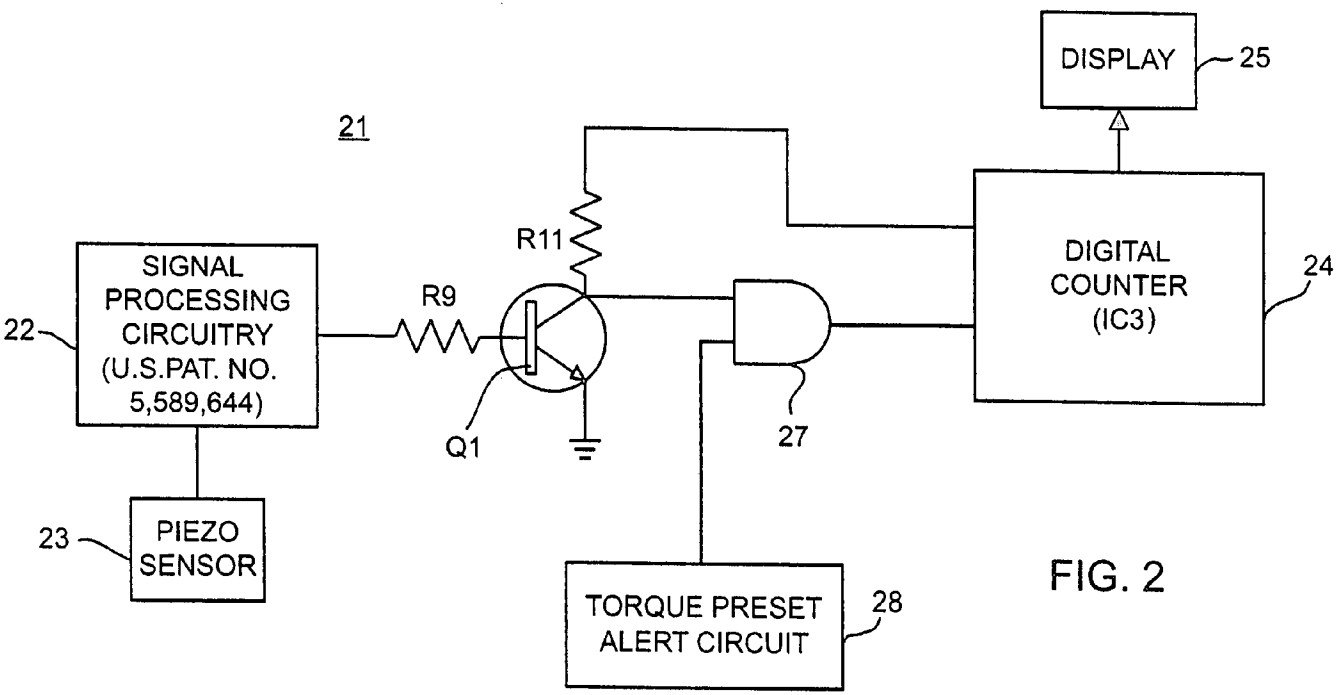
FIG. 2 is a partially schematic and partially functional block diagram of electronic circuits and components of the torque-angle wrench of FIG. 1.

Referring also to FIG. 2, the shaft 11 carries an electronics housing 20 which houses angle integration logic circuitry 21, which may be substantially the same as that disclosed in the aforementioned U.S. Pat. No. 5,589,644, whereby only so much thereof as is necessary for an understanding of the present improvements is set forth in FIG. 2. The circuitry 21 has angle sensing circuitry including signal processing circuitry 22, which may include a level shifter and a voltage-to-frequency converter, and a piezoelectric angle sensor 23 with an output coupled to the signal processing circuitry 22. The circuitry 21 further includes output circuitry, which may include a digital counter 24 and a suitable display 25 coupled to the output of the counter 24. The output of the voltage-to-frequency converter (not shown) in the signal processing circuitry 22 is coupled through a resister R9 to the base of an inverter transistor Q1, the emitter of which is grounded, and the collector of which is coupled through a resister R11 to the digital counter 24. The resistors R9 and R11 and the transistor Q1 may form part of the angle sensing circuitry. The collector of the transistor Q1 is also coupled to one input of switch circuitry in the form of an AND gate 27, the output of which is coupled to the digital counter 24. The other input of the AND gate 27 is connected to the output of a torque preset alert circuit 28, which may include a torque sensing device and a comparator which compares the output of the torque sensing device with a preset torque level to generate an output signal to the AND gate 27 when the measured torque equals or exceeds the preset torque level.

When the output of the torque preset alert circuit 28 is present at the input of the AND gate 27, the gate is enabled to pass the output of the transistor Q1, which is an inverted series of narrow pulses from the voltage-to-frequency converter, the number of pulses being proportional to the angle sensed by the sensor 23. The digital counter 24 then accumulates these pulses to complete the angle measurement function, the associated display 25 providing an angle display indicative of degrees of rotation, and visually notifying the operator when a specified angle for the particular fastener assembly is reached.

It will be appreciated that the circuitry 21 illustrated in FIG. 2 is substantially identical to that disclosed in the aforementioned U.S. Pat. No. 5,589,644, with the exception that the collector of the transistor Q1 is connected through the gate 27, instead of directly, to the digital counter 24, and the enable switch for the digital counter has been eliminated. Thus, instead of switching the digital counter 24 from a disabled to an enabled condition, that counter is always enabled, but the output pulses from the transistor Q1 are blocked therefrom by the gate 27 until the predetermined torque level is reached. Thus, any lost motion resulting from ratcheting action has no effect, because it is ignored by the circuitry 21, which does not permit angle measurement until torque of at least the predetermined level is applied.

Figure 3:
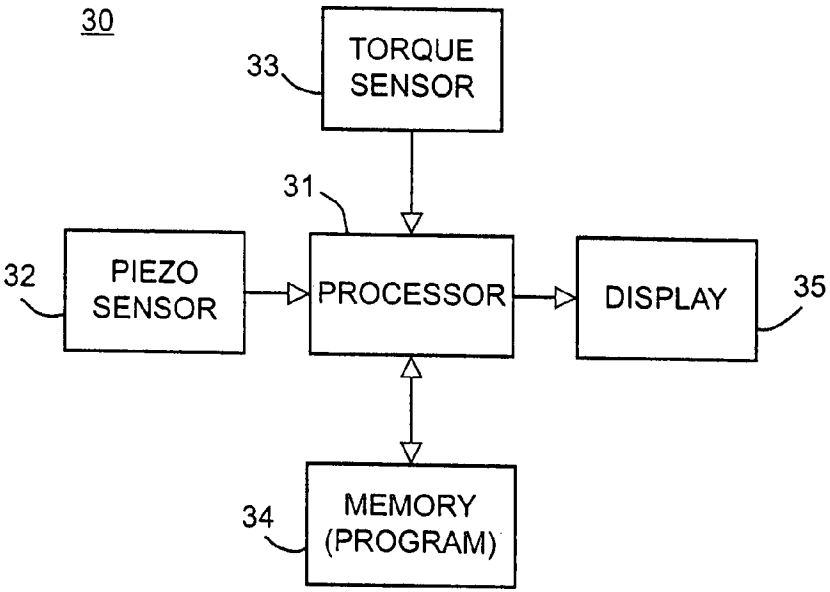
FIG. 3 is a functional block diagrammatic view of an alternative form of the circuitry for the wrench in FIG. 1.

While the forgoing description is in the context of a discrete component circuit like that described in the aforementioned U.S. Pat. No. 5,589,644, it will be appreciated that the functions thereof could also be effected in software, using a suitable processor operating under stored program control. Thus, for example, there is illustrated in FIG. 3 an alternative circuitry 30 including a processor 31 connected to the output of a piezoelectric angle sensor 32, like that described in the '644 patent, and also connected to the output of a suitable torque sensor 33. The processor 31 is coupled to a suitable memory 34, which may contain the program for the processor, and is also coupled to a suitable display device 35.

Figure 4:
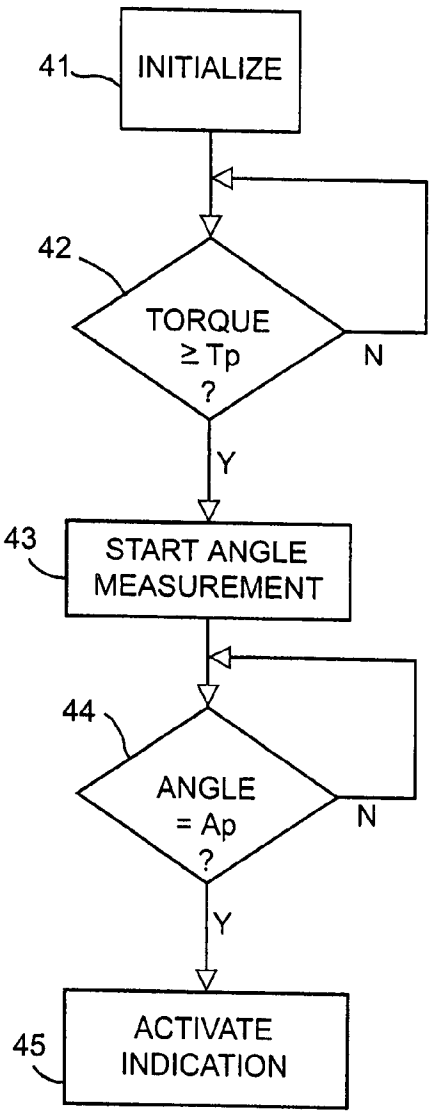
FIG. 4 is a flow chart of a software program usable in operating the circuitry of FIG. 3.

Referring to FIG. 4, there is illustrated a program 40 for operating the circuitry of FIG. 3. In operation, after initialization at 41, the processor determines at 42 if the torque sensed by the sensor 33 equals a predetermined torque level $T_p$ and then, at 43, initiates an angle measurement utilizing the output of the angle sensor 32. The processor then determines at 44 when the measured angle equals a predetermined angle $A_p$ and then, at 45, activates a suitable display indication.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A torque-angle wrench comprising:

a lever arm, a workpiece-engaging head on the lever arm, a torque preset alert circuit carried by the lever arm and providing a first signal when a predetermined torque level is reached, angle sensing circuitry carried by the lever arm and providing a second signal as a train of pulses corresponding to angular rotation of the lever arm, output circuitry including a pulse counter responsive to the second signal for providing an indication of angular rotation, switch circuitry coupled to the torque preset alert circuit and to the angle sensing circuitry and to the output circuitry for permitting the second signal to reach the output circuitry upon the occurrence of the first signal.

2. The torque-angle wrench of claim 1, wherein the head is a ratcheting head.

3. The torque-angle wrench of claim 1, wherein the switch circuitry includes a logic gate.

4. The torque-angle wrench of claim 3, wherein the logic gate is an AND gate having inputs respectively connected to the torque preset alert circuit and the angle sensing circuitry and an output connected to the output circuitry.

5. The torque-angle wrench of claim 1, wherein the angle sensing circuitry includes a piezoelectric angle sensor.

6. The torque-angle wrench of claim 1, wherein the output circuitry includes a display for providing an indication when the angular rotation reaches a predetermined level.

7. A torque-angle wrench comprising:

a lever arm, a workpiece-engaging head on the lever arm, a torque preset alert means carried by the lever arm and providing a first signal when a predetermined torque level is reached, angle sensing means carried by the lever arm and providing a second signal as a train of pulses corresponding to angular rotation of the lever arm, output means including a pulse counter responsive to the second signal for providing an indication of angular rotation, switch means, including a logic gate having an input, coupled to the torque preset alert means and to the angle sensing means and to the output means for permitting the second signal to reach the output means upon the occurrence of the first signal.

8. The torque-angle wrench of claim 7, wherein the logic gate includes AND gate means having inputs respectively connected to the torque preset alert means and the angle sensing means and an output connected to the output means.

9. The torque-angle wrench of claim 7, wherein the output means includes display means for producing a display indicating when the measured angle reaches a predetermined level.

10. The torque-angle wrench of claim 7, wherein the head is a ratcheting head.

* * * * *